United States Patent [19]

Silver

[11] 4,343,409

[45] Aug. 10, 1982

[54] LARGE HIGH TEMPERATURE PLASTIC VACUUM RESERVOIR

[75] Inventor: David S. Silver, Birmingham, Mich.

[73] Assignee: Ford Motor Company, Dearborn, Mich.

[21] Appl. No.: 253,478

[22] Filed: Apr. 13, 1981

Related U.S. Application Data

[63] Continuation of Ser. No. 87,352, Oct. 22, 1979, abandoned.

[51] Int. Cl.[3] ..... B65D 1/16; B65D 1/42

[52] U.S. Cl. ..... 220/72; 220/1 B; 220/3; 280/5 A

[58] Field of Search ..... 220/3, 1 B, 72; 215/1 C; 285/61, 62; 138/DIG. 11, 106; 206/544.8; 280/5 R, 5 A, 5 H

[56] References Cited

U.S. PATENT DOCUMENTS

| | | | |
|---|---|---|---|
| 2,042,963 | 6/1936 | Rentschler et al. . | |
| 2,106,494 | 1/1938 | Debor . | |
| 2,222,762 | 11/1940 | Debor et al. . | |
| 2,341,044 | 2/1944 | Jackson et al. | 220/3 |
| 2,462,064 | 2/1949 | Boardman . | |
| 2,672,254 | 3/1954 | Boardman . | |
| 2,702,034 | 2/1955 | Walter . | |
| 2,818,191 | 12/1957 | Arne . | |
| 2,890,485 | 6/1959 | Knowles . | |
| 3,029,963 | 4/1962 | Evers . | |
| 3,043,461 | 7/1962 | Glassco . | |
| 3,121,451 | 2/1964 | Schnerch | 220/3 X |
| 3,145,686 | 8/1964 | Blythe . | |
| 3,278,666 | 10/1966 | Donald . | |
| 3,330,439 | 7/1967 | Moorman | 220/72 X |
| 3,343,210 | 9/1967 | Guignard . | |
| 3,480,168 | 11/1969 | Lee . | |
| 3,514,812 | 6/1970 | Evers . | |
| 3,552,599 | 1/1971 | Reddins | 220/72 |
| 3,757,984 | 9/1973 | Barton | 215/1 C |
| 3,919,374 | 11/1975 | Komendowski . | |
| 3,943,987 | 3/1976 | Rossi | 206/524.8 X |

FOREIGN PATENT DOCUMENTS

| | | | |
|---|---|---|---|
| 1290641 | 3/1962 | France | 220/1 B |

*Primary Examiner*—Allan N. Shoap

*Attorney, Agent, or Firm*—Peter D. McDermott; Roger L. May

[57] ABSTRACT

A unitary reservoir (100) in FIG. 1 made of plastic, preferably made by blow molding, comprises a plurality of hollow bulbs (110), (140) and (170) with centers along a curved line in a plane, at least one bulb being a mounting bulb (140) having a mounting tower (144) or (176) extending from said bulb, said mounting tower comprising a solid portion enabling mounting of the reservoir (100) and a hollow portion that communicates with the interior of said mounting bulb and acting to resist bending of the solid portion.

6 Claims, 5 Drawing Figures

LARGE HIGH TEMPERATURE PLASTIC VACUUM RESERVOIR

This is a continuation of application Ser. No. 87,352, filed Oct. 22, 1979, now abandoned.

BACKGROUND OF THE INVENTION

This invention relates to a compact, implosion resistant, plastic reservoir of comparably large bulb volume for extended, relatively high temperature and vacuum use. In particular, the invention relates to such a reservoir that may be blow molded with partially hollow towers which enlarge its capacity and reinforce its mounting to active bodies such as car bodies.

It is well known that spherical bodies or bulbs are advantageous to withstand elevated pressure. Examples of metal and plastic spherical containers including blow molded containers appear in the following patents U.S. Pat. Nos. 3,029,963; 2,890,495; 2,818,191; 2,672,254; 2,462,064; 2,222,762; 2,106,494; 2,042,963. It is also known to construct mounting tabs for support of hollow bodies. For example, see U.S. Pat. Nos. 3,919,374; 3,514,812; 3,480,168; 3,343,210; 3,278,666; 3,145,686; 3,043,461 and 2,702,034.

It now, however, has been discovered that sturdily mountable, large sphere, hollow bodies for maintaining vacuum in such temperature environments as those encountered adjacent to automotive engine compartments may be economically fabricated from lower cost plastics, providing certain design criteria are followed.

BRIEF DESCRIPTION OF THE DRAWINGS

FIG. 3 is a section taken around III—III of FIG. 1 and shows hollow and solid portions of one mounting tower of the reservoir.

BRIEF DESCRIPTION OF THE INVENTION

The rigid, implosion resistant, plastic reservoirs of this invention may be blow molded from economically desirable thermoplastic, preferably such as polypropylene. The reservoir design preferably comprises a plurality of hollow, obtusely intersecting, intermediately ribbed-together bulbs of configuration comprising a plurality of partial spheroids that desirably may have centers along a curved line, at least one and more preferably two or more of the bulbs being mounting bulbs which have one or more integral towers extending from the bulbs with a hollow portion of each tower communicating with the mounting bulb and a closed or solid portion of each tower that enables attachment to another body such as an autobody. The hollow portion of the mounting tower has at least one wall which is in a plane that intersects a plane of the solid portion of the tower and serves to support the mount. The reservoir further comprises at least one vacuum transmittal bulb which has a rigid nozzle and flexible grommet therein.

DETAILED DESCRIPTION OF PREFERRED EMBODIMENTS

The plastic reservoirs of this invention may be blow molded using standard techniques that are well known and comprise forming the reservoir from a parison by conventional blowing agents in a mold. Preferably the plastic is a low cost thermoplastic such as polyethylene, polypropylene or the like used often in blow molding. The parison may be of uniform thickness and in larger reservoirs of the invention controlled during molding so as to insure minimum wall thicknesses. Larger reservoirs of this invention may have capacities for automotive use of at least 5000 $cm^3$ as, for example, 8000 $cm^3$ or more.

Figures 1, 2:
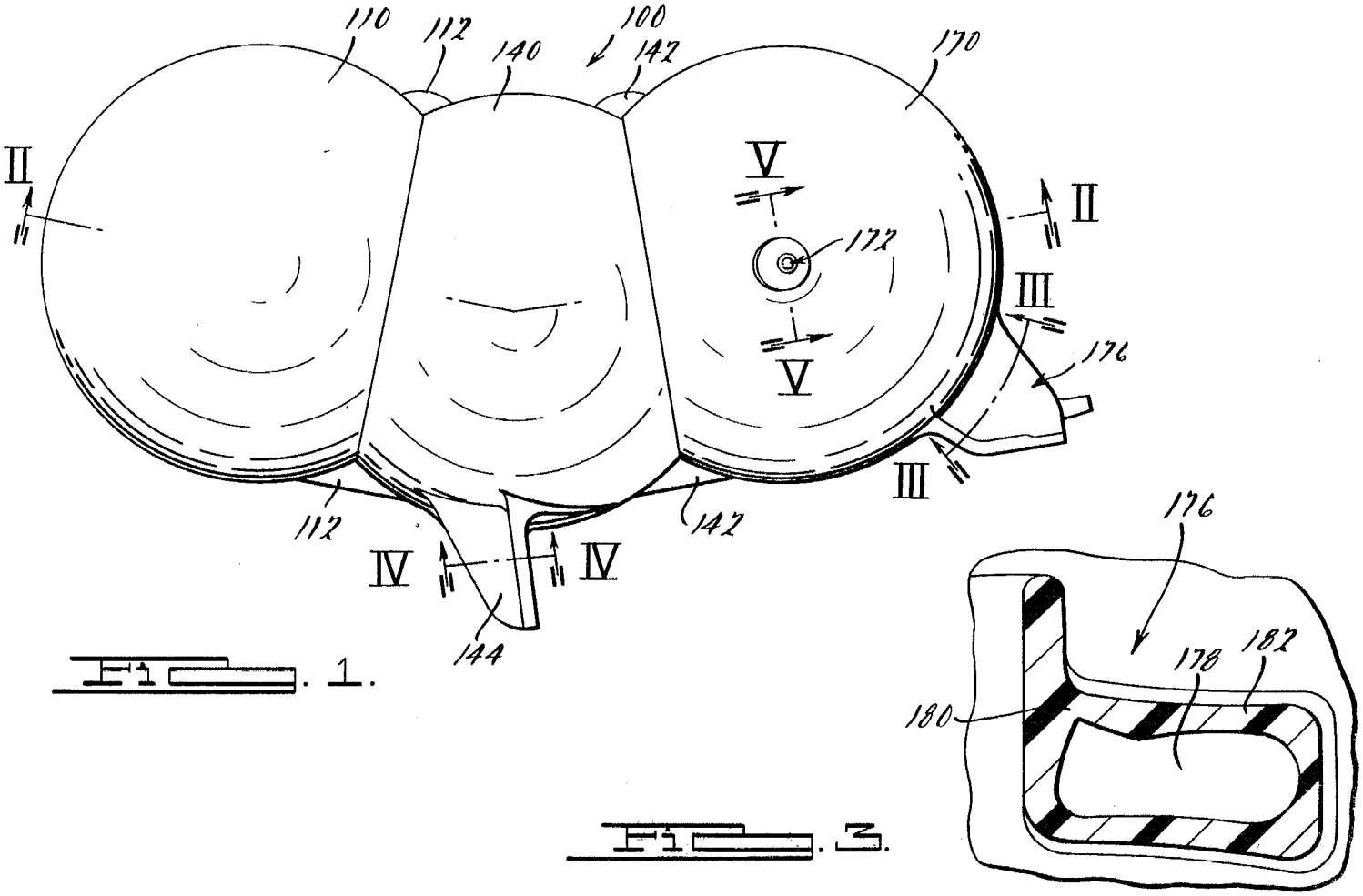
FIG. 1 illustrates external configuration of a reservoir in accordance with the invention. Mounting towers, which enable mounting in planes that are at about 90° from one another, project from the reservoir.
FIG. 2 is a section taken around II—II of FIG. 1 illustrating an internal configuration of the reservoir.
Figure 2:
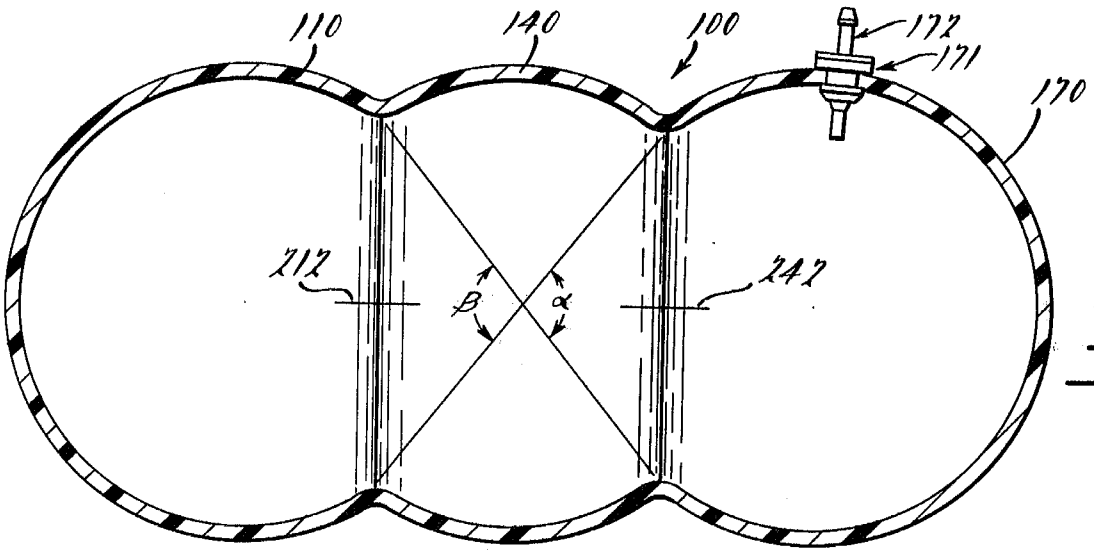

FIG. 1 shows exterior configuration of reservoir 100 of this invention having 8195 $cm^3$ capacity. The reservoir comprises three hollow, substantially spheroid bulbs 110, 140 and 170. Bulbs 110, 140 and 170 have centers along a curved line such that a line connecting the centers is an arc in a plane. This configuration permits the large capacity reservoir to have sufficient implosion resistance due to the spherical configuration of the bulbs and yet not take up undue longitudinal space due to the interconnecting of the spheres.

Intermediate ribs 112 and 142 between bulbs 110 and 140 and 140 and 170 respectively, serve to rigidify the reservoir as well as insure implosion resistant closure of the reservoir during blow molding. Individual ribs are preferably solid and all in a plane. As can be seen, the bulbs are intermediately ribbed together such that the exterior surfaces of each inner bulb (in FIG. 1, bulb 140) and any bulbs adjacent thereto (in FIG. 1, bulbs 110 and 170) have such ribs therebetween.

FIG. 1 also shows rigid plastic nozzle 172 that is mechanically held by a flexible grommet (shown more particularly in FIG. 5) which seals nozzle 172 to bulb 170 without addition of further sealant. The flexible grommet (made of polychloroprene rubber or the like) allows nozzle 172 to bend from side to side without breaking from bulb 170, thereby protecting reservoir and nozzle integrity after assembly. FIG. 1 shows mounting towers 144 and 176 that comprise hollow portions and solid portions described more particularly in FIG. 3. Towers 144 and 176 comprise means to enable securing the reservoir to another body such as through a hole (e.g. for a j-nut) in the solid portion of the tower.

FIG. 2 shows the interior of the reservoir 100 of FIG. 1 by section along II—II of FIG. 1. Bulbs 110, 140 and 170 are shown with walls of equal thickness. Such walls, however, may vary due to molding conditions, but desirably have minimal wall thickness (for thermoplastic such as polypropylene in applications as automotive headlamp door closure vacuum assist assemblies) of about 3.8 mm (preferably 4.8 mm) so as to insure adequate implosion resistance at elevated temperatures e.g. 200° F. The interior of bulbs 110, 140 and 170 have a smooth surface that is interrupted at 212 and 242 by the interior of strengthening ribs 112 and 142 hereinbefore noted. The reservoir hollow comprises the communicating interiors of bulbs 110, 140 and 170 and is of undulating configuration due to the inward extending and connection of the bulbs. Additionally, it is seen from FIG. 2 that the bulbs obtusely intersect (angles and drawn between the center of bulb 140 and the respective intersection of walls of bulbs 110 and 170 with the wall of bulb 140 being greater than 90°).

Figure 5:
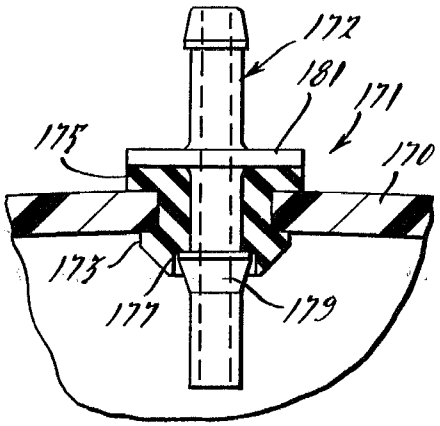
FIG. 5 is a section taken along V—V of FIG. 1 and shows the nozzle of the reservoir as well as a section of the grommet which holds the nozzle.

FIG. 2 also shows nozzle 172 with flexible grommet extending through bulb 170 as illustrated more particularly in FIG. 5.

FIG. 3 shows a section taken around III—III of mounting tower 176 of FIG. 1. The hollow 178 of mounting tower 176 communicates with bulb 170 and thereby provides an increment in reservoir capacity. The solid portion 180 of mounting tower 176 may be adapted to receive attachment means (e.g. hole for j-nut) to permit mounting of the reservoir. Walls 182 of hollow portion 178 of tower 176 support solid portion 180 such that there is resistance to bending of solid portion 180 from reservoir 170.

Figure 4:
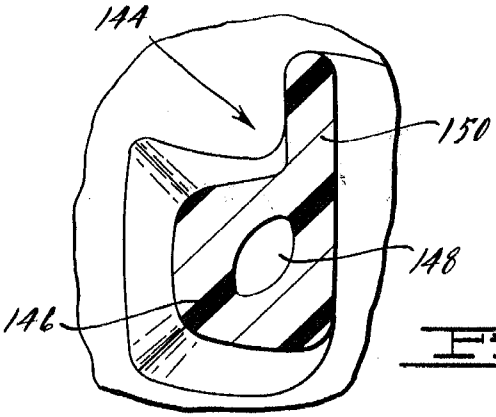
FIG. 4 is a section taken around IV—IV of FIG. 1 and also shows hollow and solid portions of another mounting tower of the reservoir.

FIG. 4 shows a section taken around IV—IV of mounting tower 144 of FIG. 1. Walls 146 of hollow portion 148 act to resist bending of solid portion 150 of mounting tower 144. Walls 146 and solid portion 150 form a solid apex (not shown) also aiding to rigidify mounting tower 144 while insuring desired implosion resistant closure.

FIG. 5 shows a section taken around V—V of FIG. 1 and shows nozzle 172 and section of flexible grommet 171 mentioned above. Grommet 171 made of polychloroprene or other flexible material seals tightly nozzle 172 to bulb 170. Grommet 171 comprises inner and outer flanges 173 and 175, respectively, and seat 177 (enlarged in figure for clarity) for inner circular nozzle flange 179.

During manufacture of the reservoir, grommet 171 is preferably first inserted into the reservoir through suitable size hole in the walls of reservoir bulb 170. Nozzle 172 thereafter is inserted into grommet 171. Tapering of flange 179 permits ease of entry into grommet 170 and the larger diameter portion of flange 179 rests tightly in grommet seat 177 to form a strong seal.

Circular outer flange 181 of nozzle 172 permits distribution of force against outer grommet flange 175 when nozzle 172 is moved inwardly or tangentially to reservoir bulb 170. Likewise, inner flange 173 permits distribution of force when nozzle 172 is moved outwardly or tangentially to reservoir bulb 170.

The flexibility of grommet 171 material acts to maintain the seal with reservoir bulb 170 when nozzle 272 is moved side to side. In such case, outer grommet flange 175 spreads to form a tight seal in a direction of rigid nozzle 172 movement outside reservoir bulb 170 and inner grommet flange 173 concomitantly spreads to form a tight seal against inner sides of the bulb in a complementary direction inside bulb 170.

Having described this invention in its particular preferred embodiments, it can be seen that many modifications of these embodiments may be made without departing from the true scope of this invention.

What is claimed is:

1. An implosion resistant, blow molded, large capacity, one piece, rigid plastic reservoir having the configuration of intersecting spheroids, comprising:

(a) a plurality of hollow bulb portions, including a first side bulb, a second side bulb, and a bulb intermediate said first and second side bulbs and attached to each, wherein:

(i) said bulbs are each spheroid to the line of attachment with each adjacent bulb;

(ii) a first line drawn between the center of the intermediate bulb and the center of the first side bulb forms an obtuse angle of intersection with a second line drawn between the center of the intermediate bulb and the center of the second side bulb; and (b) at least one mounting tower unitary with the wall of said reservoir and extending outwardly from the exterior thereof, said mounting tower comprising:

(i) a first portion suitable for mounting the reservoir, and (ii) a second portion unitary with said first portion, attached at an angle thereto, whereby the first portion is strengthened against bending; and (c) a reinforcing rib unitary with the wall of said reservoir located along each line of attachment between adjacent bulbs;

wherein the center of a bulb is the center of a complete sphere coincident therewith.

2. An implosion resistant, blow molded, large capacity, one piece, rigid plastic reservoir according to claim 1, wherein said second portion of said mounting tower comprises a hollow interior region communicating with the interior of said reservoir.

3. The reservoir in accordance with claim 2, wherein said first portion defines in part said hollow region.

4. An implosion resistant, blow molded, large capacity, one piece, rigid plastic reservoir having the configuration of intersecting spheroids, comprising:

(a) a plurality of hollow bulb portions, including a first side bulb, a second side bulb, and a bulb intermediate said first and second side bulbs and attached to each, wherein:

(i) said bulbs are each spheroid to the line of attachment with each adjacent bulb;

(ii) a first line drawn between the center of the intermediate bulb and the center of the first side bulb forms an obtuse angle of intersection with a second line drawn between the center of the intermediate bulb and the center of the second side bulb; and (iii) said bulbs are centered along an arc in a plane;

(b) at least one mounting tower unitary with the wall of said reservoir and extending outwardly from the exterior thereof, said mounting tower comprising:

(i) a first portion suitable for mounting the reservoir, and (ii) a second portion unitary with said first portion, attached at an angle thereto, whereby the first portion is strengthened against bending; and (c) a reinforcing rib unitary with the wall of said reservoir located along each line of attachment between adjacent bulbs;

wherein the center of a bulb is the center of a complete sphere coincident therewith.

5. The reservoir in accordance with claim 4, wherein said first portion and said second portion are at least in part generally perpendicular to one another.

6. The reservoir in accordance with claim 5, 3, 1, 4, or 2 wherein said reservoir is made from thermoplastic comprising polypropylene.

* * * * *